United States Patent [19]

Kallmes

[11] Patent Number: 4,561,938

[45] Date of Patent: Dec. 31, 1985

[54] FORMING ROLL APPARATUS

[75] Inventor: Otto J. Kallmes, Marblehead, Mass.

[73] Assignee: M/K Plank Corporation, Danvers, Mass.

[21] Appl. No.: 642,823

[22] Filed: Aug. 21, 1984

Related U.S. Application Data

[63] Continuation-in-part of Ser. No. 581,124, Feb. 17, 1984, abandoned.

[51] Int. Cl.[4] ..... D21F 1/40; D21F 1/50

[52] U.S. Cl. ..... 162/314; 162/301; 162/352; 162/364

[58] Field of Search ..... 162/314, 313, 312, 308, 162/301, 300, 348, 352, 374, 364, 368, 369

[56] References Cited

U.S. PATENT DOCUMENTS

| | | | |
|---|---|---|---|
| 542,581 | 7/1895 | Young . | |
| 2,473,269 | 6/1949 | Adams . | |
| 2,473,270 | 6/1949 | Adams . | |
| 2,644,373 | 7/1953 | Salvaneschi . | |
| 2,995,186 | 8/1961 | Montigny | 162/295 |
| 3,087,538 | 4/1963 | Newman | 162/297 |
| 3,201,305 | 8/1965 | Webster | 162/203 |
| 3,432,385 | 3/1969 | Thorp | 162/297 |
| 3,573,159 | 3/1971 | Sepall | 162/208 |
| 3,819,474 | 6/1974 | Holz | 162/314 |
| 3,844,881 | 10/1974 | Moody | 162/297 |
| 3,922,190 | 11/1975 | Cowan | 162/374 |
| 4,154,645 | 5/1979 | Kankaanpaa | 162/205 |
| 4,176,005 | 11/1979 | Bubik et al. | 162/300 |
| 4,417,950 | 11/1983 | Bubik et al. | 162/352 |
| 4,459,175 | 7/1984 | Bubik et al. | 162/300 X |

*Primary Examiner*—S. Leon Bashore
*Assistant Examiner*—K. M. Hastings
*Attorney, Agent, or Firm*—Witherspoon & Hargest

[57] ABSTRACT

A forming roll positioned in the forming section of a Fourdrinier papermaking machine and supported above the forming medium in contact with one surface of a constituent material to sandwich the material between a substantial arc segment of the forming roll surface and the forming medium.

19 Claims, 3 Drawing Figures

FORMING ROLL APPARATUS

This is a continuation-in-part of application Ser. No. 581,124 filed on Feb. 17, 1984, now abandoned.

BACKGROUND OF THE INVENTION

1. Field of the Invention

This invention relates to a forming roll which is a rotatable cylindrical roll positioned in the forming section of a Fourdrinier papermaking machine and supported above the forming medium in contact with one surface of a web being formed to sandwich between the roll surface and the forming medium the constituent material which forms the web. The forming roll is particularly useful in the actual formation of a paper web as well as in the improvement in the formation quality of the paper web.

2. Description of the Prior Art

In the typical Fourdrinier papermaking machine, an aqueous suspension of fibers, called the "stock" is flowed from a headbox onto a traveling Fourdrinier wire or medium, generally a woven belt of wire and/or synthetic material, to form a continuous sheet of paper or paper-like material. In this connection, the expression "paper or paper-like material" is used in a broad or generic sense and is intended to include such items as paper, kraft, board, pulp sheets and non-woven sheet-like structures. As the stock travels along on the Fourdrinier wire, formation of a paper web occurs, as much of the water content of the stock is removed by draining. Water removal is enhanced by the use of such well-known devices as hydrofoils, table rolls and/or suction devices. Subsequent to the formation of the paper web, the paper web may be caused to engage a dandy roll to improve both the formation of the sheet and the quality of its surface. While water is being removed from the stock and the paper web is being formed and thickened, the consistency of the constituent material varies from the consistency of the stock at the headbox, which may be about 0.5 to 1%, to the consistency of the fully-formed paper web, about 2 to 2.5%, and finally as it engages the dandy roll, usually about 3% to 4%. It is generally understood that until such time as the paper web is fully-formed at a consistency of about 2 to 2.5%, the forming medium carries a partially-formed web with some still unformed stock above it. The terms "web/stock sandwich" and "constituent material" are used interchangeably herein to identify the combined partially-formed web having the unformed stock above it.

In recent years, there has been a desire to increase the efficiency of the Fourdrinier machine while at the same time increase the quality of the paper being formed. In attempting to meet these objectives, efforts have been made to modify existing machines. For example, as noted herein, it has long been known to improve the quality of the paper being formed in the forming section of a Fourdrinier machine by positioning a dandy roll above the forming medium and in contact with the paper web at a point where the paper web has already been formed and the average consistency of such web is about 3% to 4%. Usually, suction devices such as suction boxes have been positioned upstream and downstream of the dandy roll to facilitate the use thereof. Efforts to improve the results obtained by use of such dandy rolls have included the use of rolls having greater diameters than the diameter of a standard dandy roll in order to increase the surface area of the roll against which the paper web is urged by the forming medium. In fact, dandy rolls having a diameter of up to six feet are known to be in use. However, there has been a tendency in modern Fourdrinier machines to increase machine speed, and the combination of greater machine speed and dandy roll diameter has not been entirely satisfactory. For example, in such applications there has been a tendency for an excessive amount of water to be flung back upon the web when it is separated from the dandy roll during the papermaking operation.

In a further effort to increase the usefulness of the dandy roll in improving the formation quality of paper, a partially-formed web with some still unformed stock above it at an average material consistency in the 1.5 to 2% range has been known to engage a dandy roll dipping significantly, 3 to 4 inches, down into the forming medium to increase the surface area of roll against which the web/stock sandwich is urged by the forming medium. To facilitate operation of such an embodiment, the suction boxes positioned upstream and downstream of the dandy roll have been tilted so that the surfaces of the suction box covers substantially conform to the path traversed by the slightly curving forming medium in the vicinity of the dandy roll. Such structure has been useful in improving the formation quality of the paper web at papermaking machine speeds not in excess of 1000 f.p.m. However, at greater speeds there is a tendency for the disruption, due to its momentum, of the stock over the partially-formed web in the vicinity where it first engages the dandy roll.

In another known apparatus described in West German patent application DE No. 3142O54 A1 in the name of Bubik et al, a fiber suspension is delivered upon a traveling Fourdrinier wire. The suspension is subsequently sandwiched between the wire and the porous traveling surface of a dewatering element such as a dewatering cylinder positioned above the wire. To effect such sandwiching, the wire and suspension are guided downward over a first element such as a first guiding cylinder or roll positioned beneath the wire and upstream of the dewatering cylinder, and then guided upward over a second element such as a second guiding cylinder or roll positioned beneath the wire and downstream of the dewatering cylinder. In this manner the wire travels in essentially the same plane before the first element and after the second element and is caused to deviate from such plane at the dewatering element. The area beneath the wire extending from the position where the wire disengages the first element to the position of deepest penetration of the wire by the dewatering element, is provided with a vacuum zone. The Bubik et al application states that by using such structure, back flow originating in the upper portion of the fiber suspension is prevented at the entrance of the suspension onto the dewatering element. In addition, it is stated that such structure prevents a strong back flow in the zone between the first element and the dewatering element, and that the prevention of such back flow prevents damage to the fiber formation. In the foregoing application, recognition is made of the fact that in the absence of the use of vacuum in such vacuum zone, the upper layer of the fiber suspension will impact against the dewatering element at a relatively steep angle and at a relatively high impact point as a result of the centrifugal force in operation upon the suspension, and that such impact causes harmful back flow in the upper layer of the fiber suspension which can damage the formation of the stock fibers in this upper region. To further assist in the operation of the apparatus described in the foregoing application, it is stated that a pressure area is positioned in a zone generally existing between the deepest penetration of the wire by the dewatering element and the second element.

The use of such a vacuum zone in the apparatus of Bubik et al is not believed to be adequately satisfactory in preventing surface disruption of the fiber suspension at machine speeds in excess of 800 f.p.m. In addition, any advantage resulting from the dewatering associated with the downstream pressure zone is believed to be offset by the problem of maintaining the fiber suspension upon the Fourdrinier wire as the wire passes over the second element and continues on to the next phase of the papermaking operation in the presence of such pressure.

Other efforts directed to the modernization of existing machinery have included the conversion of standard Fourdrinier machines into what has been referred to in the industry as "hybrid formers." Generally, a hybrid former includes a typical Fourdrinier section of a papermaking machine having a twin-wire former installed on top of the existing forming medium. More particularly, in such a structure an endless belt or wire is placed above the forming medium and is caused to travel around a plurality of rolls to squeeze the web against the forming medium. The upper wire and the paper web travel around a portion of a large diameter roll and then arcs around additional rolls, suction being applied to the forming medium after it leaves the last roll, to assure that the paper web adheres to the forming medium and continues through the papermaking process.

The installation of a hybrid former involves the use of relatively complex and expensive apparatus. Such apparatus may include multiple rolls such as those required for guiding and stretching the upper belt or wire. In addition, various dewatering devices need be provided, as well as shower means and the like for cleaning the upper belt or wire. Installation of a hybrid former also requires proper alignment on its support structure to assure proper operation, a task which is complicated due to the excessive weight of the twin wire apparatus which may be as high as 110 tons.

Accordingly, it is an object of this invention to provide a means whereby the efficiency of a Fourdrinier machine and the quality of the product produced thereon may be increased without the use of complex and costly apparatus, and with minimum modification of existing machinery.

Another object of this invention is to increase the efficiency of a Fourdrinier machine and the quality of the product produced thereon without the need for a top wire or fabric loop traveling about a plurality of rolls and other associated apparatus positioned above the forming medium, and without the alignment problems associated with use of such a top wire.

Yet another object of this invention is to increase Fourdrinier machine efficiency and paper quality by the use of relatively simple apparatus capable of being located at a position above the forming medium where the average consistency of the constituent material is about double that of the stock consistency at the headbox.

Still another object of this invention is to increase the surface area of a forming roll against which the constituent material is sandwiched by a forming medium without requiring an increase in the diameter of the forming roll.

A further object of this invention is to obtain the advantages of a hybrid former without a top wire or fabric loop and the plurality of rolls associated therewith by positioning a forming roll in the forming section of a Fourdrinier machine above the forming medium where the average consistency of the constituent material is less than about 2%.

Yet a further object of this invention is to achieve all the foregoing objects on a Fourdrinier machine operating at any machine speed including a speed in excess of 800 feet per minute (f.p.m.).

Another object of this invention is to achieve all of the foregoing objects on a Fourdrinier machine in which the degree of surface area of a forming roll against which the constituent material is sandwiched by a forming medium is substantially increased without the use of vacuum augmenting apparatus beneath the forming medium in the general area preceding where the constituent material first engages the forming roll.

Yet another object of this invention is to achieve all of the foregoing objects on a Fourdrinier machine in which the degree of surface area of a forming roll against which the constituent material is sandwiched by a forming medium is substantially increased without the use of a pressure zone beneath the forming medium in the general area where the paper web disengages the forming roll.

A further object of this invention is to achieve all of the foregoing objects on a Fourdrinier machine while substantially eliminating disruption of the product being processed in the general area where the constituent material engages and the paper web disengages the forming roll.

SUMMARY OF THE INVENTION

This invention achieves these and other objects by providing apparatus for use in the forming section of a paper making machine for use in producing a paper-like material upon a forming medium arranged for movement through a horizontal plane. In forming the paper-like material, the material is initially formed upon the forming medium to engage a forming roll as a web/-stock sandwich and subsequently disengage the forming roll as a fully-formed web. Actually, the web/stock sandwich is a partially formed web carried upon the forming medium and having some residual stock above it. The apparatus comprises a forming roll positioned adjacent a web/stock sandwich contacting surface of the forming medium, the roll having a stock engaging surface. First directing means are positioned upstream of the forming roll for directing the web/stock sandwich carried by the forming medium into engagement with the roll surface in the absence of negative pressure means, which induces negative pressure upon said web through the forming medium, in the area between the first directing means and where the web/stock sandwich first engages the roll surface. Second directing means are positioned downstream of the forming roll for directing the fully-formed web carried by the forming medium away from the roll surface, the first and second directing means engaging the side of the forming medium which does not contact the web and together sandwiching the constituent material between the forming medium and a substantial arc segment of the surface in the absence of positive pressure means, which exerts positive pressure upon the web through the forming medium, in an area which includes the area formed by the substantial arc segment and extends to the second directing means. Means are also positioned on the side of the forming medium which does not contact the web for providing negative pressure through the forming medium in at least a portion of the area which includes the area formed by the substantial arc segment and extends to the second directing means. The forming roll referred to herein is of the type which does not include vacuum augmenting means therein. In other words, the forming roll does not include internal thereof suction means for drawing water from the web through and into the roll.

BRIEF DESCRIPTION OF THE DRAWINGS

It should be noted that in order to simplify the drawings similar reference numerals in FIGS. 1 to 3 identify corresponding-type structure.

DESCRIPTION OF THE PREFERRED EMBODIMENTS

Figure 2:
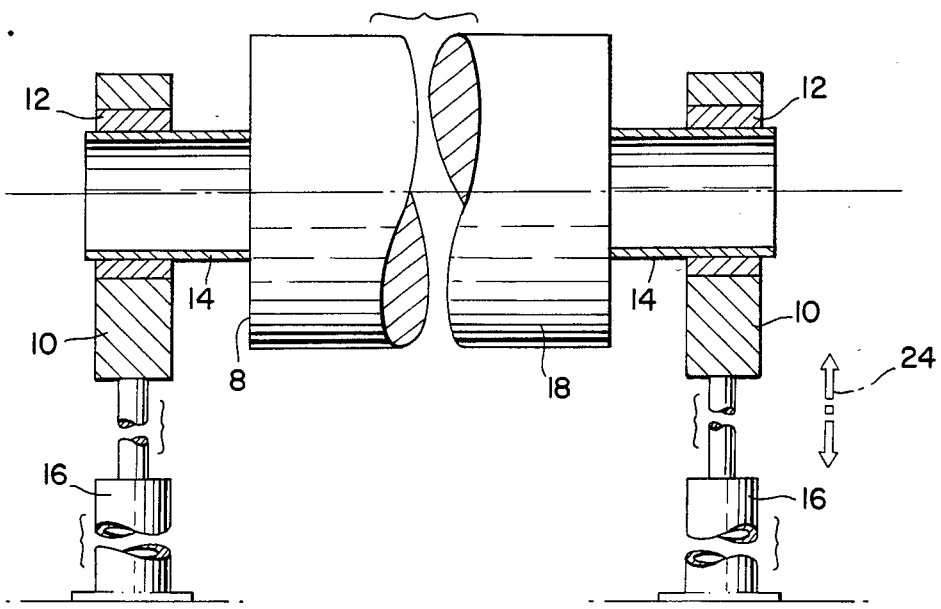
FIG. 2 is a partial sectional view of a diagramatic representation of an adjustable roll embodying the present invention; and, FIG. 3 is a diagramatic representation of yet another embodiment of the present invention.
Figure 1:
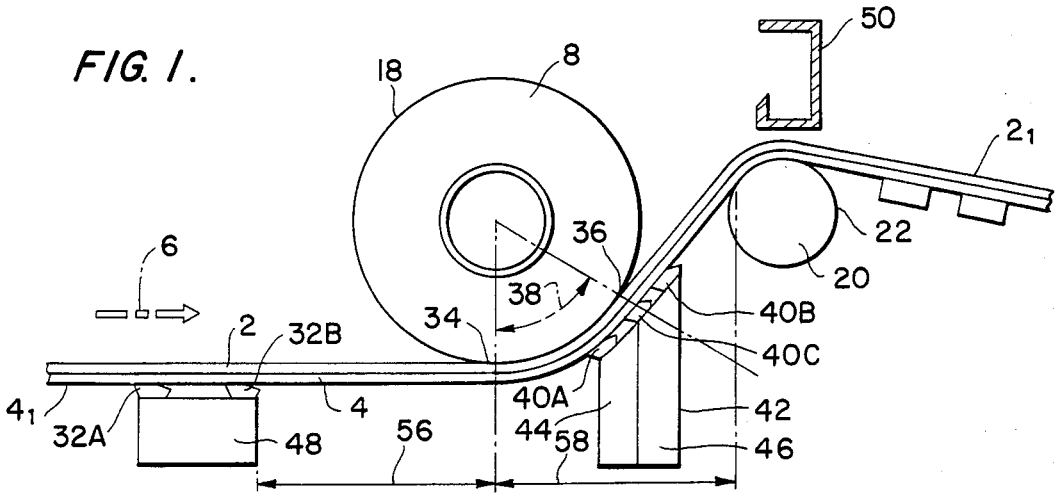
FIG. 1 is a diagramatic representation of one embodiment of the present invention.

The embodiment of this invention which is illustrated in FIGS. 1 and 2 is one which is particularly suited for achieving the objects of this invention. FIG. 1 depicts a portion of the forming section of a papermaking machine of the type wherein a forming medium receives stock from a headbox at a first end (not shown) and transfers a substantially self supporting paper web from the forming medium at a second end (not shown). In the forming section a portion of a web is formed from the stock into a web/stock sandwich 2 which is carried upon a forming medium 4 arranged for movement in the direction of arrow 6 generally in a horizontal plane $4_1$ other than where the forming medium is diverted away from plane $4_1$ by the forming roll 8 and equipment associated therewith. Forming roll 8 is adapted to engage the surface of the stock of the web/stock sandwich 2, and is preferably a cylindrical roll having a foraminous surface and constructed in the manner of a conventional dandy roll which is well known in the art. Ecxept as noted herein specific structure of the roll 8 forms no part of this invention. Forming roll 8 may be attached at each end thereof to a vertically oriented standard 10 having a bearing 12 into which the axle 14 of roll 8 extends. A suitable actuator is provided, as, for example, hydraulic means 16 to allow roll 8 to be selectively positioned to space the surface 18 of roll 8 relative to the horizontal plane of the forming medium 4 as desired. Forming roll 8 does not include any supplementary belts and is therefore of the type wherein of the combined forming roll structure the surface 18 is the sole contact with the web/stock sandwich 2. In operation, the stock is deposited on the forming medium at headbox consistency and is partially formed prior to engagement with the forming roll 8. Formation is completed and a paper web having a smooth and substantially finished surface is formed as the partially formed web carrying the surface layer of stock is sandwiched between the forming medium 4 and forming roll 8. For example, stock having a consistency of about 0.5 to 1% may be deposited upon the forming medium, engage the forming roll at a consistency about double that of the headbox consistency, 1 to 2%, and subsequently disengage the forming roll at a consistency above about 4%.

The apparatus includes first directing means positioned upstream of the forming roll 8. The first directing means directs the web/stock sandwich 2 carried by the forming medium 4 into engagement with the surface 18 of the forming roll 8.

The apparatus also includes second directing means positioned downstream of the forming roll 8. The second directing means directs the fully-formed paper web $2_1$ carried by the forming medium 4 away from surface 18 of forming roll 8, and back towards the horizontal plane identified at $4_1$.

The first and second directing means engage the side of the forming medium 4 which does not contact the paper web $2_1$ and together sandwich the constituent material between the forming medium 4 and a substantial arc segment of surface 18. When used herein the phrase "substantial arc segment" is meant to identify an arc segment of at least 20°.

The first and second directing means may include, without limitation, an open roll not unlike a dandy roll, a suction roll, a curved shoe, a suction box or other dewatering apparatus, and the like. For example, as depicted in FIG. 1, the second directing means includes an open roll 20 positioned beneath the forming medium 4 and extending in the cross machine direction which is a direction substantially at a right angle to the machine direction 6 which is the direction in which the forming medium travels during the papermaking operation. Roll 20 extending across the width of the machine, may be attached at each end thereof to apparatus of the type depicted in FIG. 2 to allow the roll 20 to be selectively positioned to space roll surface 22 relative to the horizontal plane of the forming medium 4 as desired. It will be apparent to those skilled in the art that by moving roll 20 in a vertical direction as identified by arrow 24 the degree to which the constituent material is sandwiched between forming medium 4 and roll surface 18 may be controlled. It will be equally apparent to those skilled in the art that whether or not one or both of rolls 8 and 20 are moveable in any other direction the degree of the arc segment of the roll 18 against which the forming medium sandwiches the web/stock sandwich 2 will be dependent to a certain extent upon the position of surface 18 relative to surface 22.

In the embodiment of FIG. 1, the first directing means is depicted as comprising a plurality of hydrofoil blades as for example blades 32A and 32B positioned beneath the forming medium and extending in the cross machine direction in a known manner. The blades 32A and 32B working in combination with the open roll 20 direct the forming medium 4 so as to direct the web/stock sandwich 2, which may have a consistency of less than about 2%, into engagement with surface 18 at the location designated 34 and so as to direct the fully formed web $2_1$, which may have a consistency of about 4% to 8%, away from surface 18 at the location designated 36. It is between the locations 34 and 36 that the forming medium sandwiches the constituent material against a substantial arc segment, designated 38, of surface 18. The plurality of blades 32 are preferably attached to a foil box 48 in a known manner, and at least one of the blades may be vacuum augmented if desired.

In the embodiment of FIG. 1, the plurality of hydrofoil blades 32A and 32B work in combination with the open return roll 20 to direct (a) the forming medium 4 and the web/stock sandwich into tangential engagement with surface 18 at the location designated 34 and (b) the forming medium 4 and the fully-formed web $2_1$ away from surface 18 at the location designated 36. The embodiment depicted in FIG. 1 is particularly suitable for higher speed Fourdrinier machines as, for example, those machines operating in excess of about 800 feet per minute. In such applications it may be desirable to adjust the equipment as described herein so that the constituent material is sandwiched between the forming medium and an arc segment 38 of the roll surface ranging between about 30° to 90°. For example, arc segment 38 in FIG. 1 is about 50°.

Figure 3:
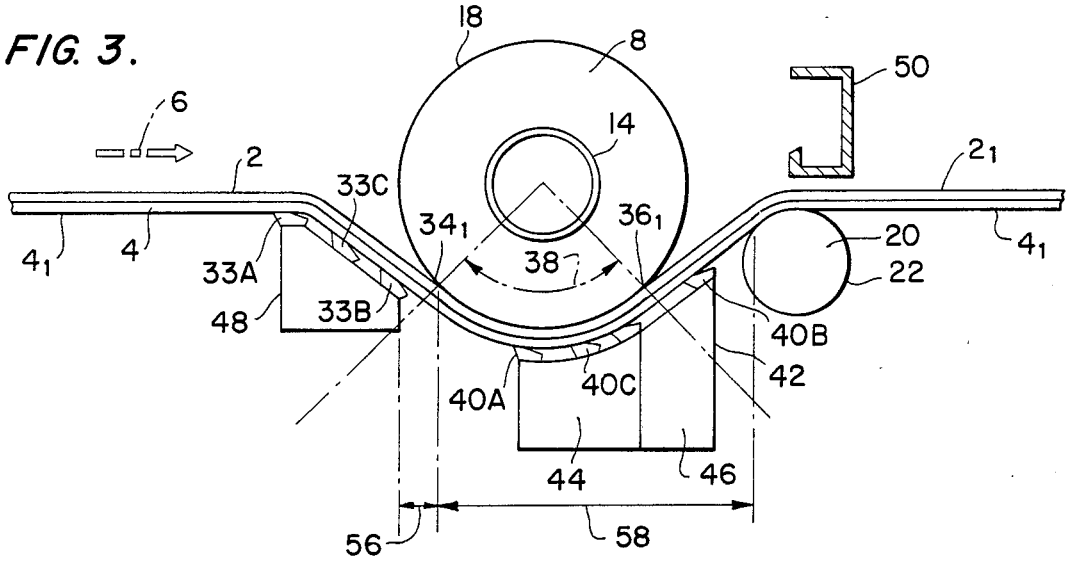

In the alternative embodiment depicted in FIG. 3, a first directing means comprising a plurality of hydrofoil blades as for example blades 33A and 33B positioned beneath the forming medium 4, and extending in the cross machine direction in a known manner work in combination with the second directing means comprising the open return roll 20 to direct the forming medium 4 and web/stock sandwich 2 into engagement with surface 18 at the location designated $34_1$ and the formed web $2_1$ away from surface 18 at the location designated $36_1$. The plurality of blades 33 include at least a first blade 33A and a second blade 33B oriented to conform to the forming medium. For example, the second blade 33B is positioned downstream of the first blade 33A. In addition, blade 33B is further removed from the horizontal plane of the forming medium 4 than is blade 33A. One or more additional blades may also be provided and oriented to conform to the forming medium. For example, in the drawings an additional blade 33C is provided. In this manner, a plurality of blades may be provided comprising a first blade and at least one other succeeding blade, each of the succeeding blades being downstream of, and further removed from the horizontal plane of the forming medium than the first blade and any preceding blades. The plurality of blades 33 are preferably attached to a foil box 48 of the type described herein regarding the embodiment of the present invention depicted in FIG. 1.

In the embodiments of FIGS. 1 and 3, the first directing means directs the web/stock sandwich 2 carried by the forming medium 4 into engagement with the surface of the forming roll in the absence of negative pressure means in the area between the first directing means and where the constituent material first engages the roll surface. This position is generally identified at 56 in the drawings. It has been determined that in the embodiments described herein it is not necessary to induce negative pressure upon the web through the forming medium in the area extending across the machine width at 56, and therefore negative pressure means are not positioned at this location.

In a like manner, in the embodiments of FIGS. 1 and 3, the second directing means directs the paper web carried by the forming medium away from the surface of the forming roll in the absence of positive pressure means in the area which includes the area formed by the arc segment 38 and $38_1$ and extends to the second directing means. This position is generally identified at 58 in the drawings. It has been determined that in the embodiments described herein it is not necessary to exert positive pressure upon the paper web through the forming medium in the area extending across the machine width at 58, and therefore positive pressure means are not positioned at this location.

In the embodiments of the present invention, means are also positioned on the side of the forming medium 4 which does not contact the web for providing negative pressure through the forming medium to assist in dewatering and paper web formation and to draw the web against the forming medium as the forming medium is directed away from the forming roll at the location designated 36 and $36_1$. Such means extend across the machine width and in the machine direction for a length equal to at least a portion of the area which extends from the area formed by the arc segment 38 and $38_1$ to the second directing means. In other words, such means extend in the cross machine direction for a length measured in the machine direction equal to at least a portion of the position which is generally identified at 58 in the drawings. For example, in the embodiments of FIGS. 1 and 3, such negative pressure means include a plurality of hydrofoil blades positioned beneath the forming medium adjacent to roll 8 and extending in the cross machine direction. Such blades are depicted as conforming to the underside of the forming medium 4 and include at least a first blade 40A and a second blade 40B. The second blade 40B is positioned downstream of the first blade 40A. In addition, blade 40A is further removed from the horizontal plane of the forming medium than is blade 40B. One or more additional blades 40C may also be provided and oriented to conform to the forming medium. In this manner, a plurality of blades may be provided comprising a first blade and at least one other succeeding blade, each of the succeeding blades being downstream of, and closer to the horizontal plane of the forming medium than, the first blade and any preceding blades. Preferably, such blades are attached to a foil box 42 in a known manner and at least one of the blades may be vacuum augmented. For example, foil box 42 which extends in the cross machine direction for the full width of the forming medium 4 includes a first chamber 44 beneath at least one of the blades 40 and a second chamber 46 beneath at least one other of the blades 40. In the apparatus, chamber 44 is vacuum augmented at one negative pressure, and chamber 46 is vacuum augmented at another negative pressure, usually but not necessarily greater. In the embodiments of FIGS. 1 and 3 the open roll 20 is positioned downstream of the suction means and in particular is positioned downstream of the second chamber 46, and the plurality of hydrofoil blades 32 and 33 is positioned upstream of the plurality of hydrofoil blades 40.

Hydrofoil blades referred to herein may be conventional equipment used in the forming section of Fourdrinier papermaking machines. Such a conventional hydrofoil blade is a stationary blade-like structure positioned beneath the forming medium in supporting relationship thereto. The functions of the hydrofoil blade include extracting water from the furnish or stock and otherwise assuring proper formation of the paper web being formed. However, the present invention is not limited to such conventional blades. For example, the hydrofoil blades referred to herein may be pulse inducing blades having a dewatering configuration of the type described in Sepal, U.S. Pat. No. 3,573,159. In the preferred embodiment hydrofoil blades 32 are conventional blades and hydrofoil blades 40 are of the pulse inducing type.

Means also may be positioned adjacent and downstream of forming roll 8 above forming medium 4 and extending in the cross machine direction for catching water which may be flung from the forming roll during the operation thereof. As depicted in the drawings such catching means may include a catch pan 50 mounted at both sides of the papermaking machine in a known manner.

The operation of the invention will now be described with reference to the apparatus of FIG. 1. Initially, stock is flowed onto the Fourdrinier forming medium 4 from a head box (not shown). As the forming medium travels in the direction identified by arrow 6, water is removed and a portion of a web is formed in a known manner. Until the average consistency of the material reaches 2 to 2.5%, there is still residual stock at a consistency equal to or slightly higher than the headbox consistency above the formed web. The hydrofoil blades 32 direct the forming medium 4 such that the forming roll 8 makes its initial contact with the stock at the point of tangency identified by reference numeral 34. The forming medium carrying the constituent material progresses and is caused to engage roll surface 18 throughout the arc segment 38 which represents a wrap of about 50°.

Without wishing or intending to be bound by a theory of operation, it is believed that during about the first half of the wrap dewatering is caused only by the pressing action of the forming medium against the forming roll. Although the bulk of the water so removed passes into the forming roll from the stock suspension on the top of the partially formed web, some water is forced downwardly through the forming medium. In addition to removing water, the squeezing action causes improvement in sheet uniformity. During the second half of the wrap, the forming medium passes over the vacuum augmented hydrofoil blades 40 causing the bulk of the water at this portion of the wrap to be drawn downward through the forming medium. The effect of the suction applied by the hydrofoil blades 40 and the augmented vacuum causes the substantially formed web to follow the forming medium rather than to adhere to the forming roll as the web and forming medium disengage the roll at the position identified by reference numeral 36.

Much of the water which has passed into roll 18 will be flung centrifugally out of the roll after the forming medium and roll disengage at 36. Such water will be caught by pan 50. The forming medium carrying the formed web then passes over the open return roll 20, a plurality of suction devices and the couch roll (not shown) as the forming medium travels back to the horizontal plane identified by arrow 6.

Regarding the operation of the embodiment of FIG. 3, the blades 33 are not subjected to vacuum agumenting means. In fact, preferably the blades will be designed such that the forming medium 4 engages the leading surface and the trailing surface of the blades in such a manner that the dewatering typical of conventional hydrofoil blades is minimized or substantially eliminated. In this manner, and by changing the wire direction in small increments from blade 33A to blade 33B, surface disruption of the layer of stock carried by the web is believed to be substantially eliminated as the forming medium travels away from plane $4_1$ and the web/stock sandwich engages the roll at $34_1$.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. Apparatus for use in the forming section of a papermaking machine for use in producing a paper-like material upon a forming medium having a horizontal forming surface arranged for movement through a horizontal plane wherein in forming said paper-like material, said material is initially formed upon said forming medium to engage a forming roll as a web/stock sandwich and subsequently disengage said forming roll as a fully-formed web, said apparatus comprising in combination:

(a) a forming roll not having internal suction means or supplementary belts positioned adjacent a web contacting surface of said forming medium, said roll having a stock-engaging surface, said roll being located a distance downstream along said horizontal forming surface;

(b) first directing means positioned on the side of said forming medium which does not contact said web and spaced upstream of said forming roll for directing said web/stock sandwich carried by said forming medium into engagement with said roll surface in the absence of negative pressure means, which induces negative pressure upon said web through said forming medium, in the area between said first directing means and where said web/stock sandwich first engages said roll surface;

(c) second directing means positioned on the side of said forming medium which does not contact said web and spaced downstream of said forming roll for directing said fully-formed web carried by said forming medium away from said stock engaging surface, said first and second directing means engaging the side of said forming medium which does not contact said web and together sandwiching said web/stock sandwich between said forming medium and a substantial arc segment of said stock engaging surface of said roll in the absence of positive pressure means, which exerts positive pressure upon said web through said forming medium, in an area which includes said area formed by said substantial arc segment and extends to said second directing means;

(d) suction means positioned on the side of said forming medium which does not contact said web/stock sandwich and between said first and second directing means for providing negative pressure through said forming medium in at least a portion of said area which includes said area formed by said substantial arc segment and extends to said second directing means, said at least a portion including a portion of said substantial arc segment formed with said roll and a portion of the area between said substantial arc segment formed by said roll and said second directing means; and, (e) said suction means comprising a plurality of vacuum inducing hydrofoil blades which extend across the width of said machine including a first blade and at least one other succeeding blade, each of said at least one other succeeding blades being downstream of said first blade and any other preceding blade, said plurality of hydrofoil blades being positioned beneath the forming medium adjacent to said roll at said portion of said substantial arc segment formed with said roll and said portion of said area between said substantial arc segment formed by said roll and said second directing means.

2. The apparatus of claim 1 wherein said first directing means includes another plurality of vacuum inducing hydrofoil blades extending across the width of said machine.

3. The apparatus of claim 1 wherein said second directing means includes a roll extending across the width of said machine.

4. The apparatus of claim 2 wherein said second directing means includes a roll extending across the width of said machine.

5. The apparatus of claim 2 wherein said another plurality of blades comprises a first blade and at least one other succeeding blade, each of said at least one other succeeding blades being downstream of, and further removed from said horizontal plane than, said first blade and any other preceding blade.

6. The apparatus of claim 4 wherein said another plurality of blades comprises a first blade and at least one other succeeding blade, each of said at least one other succeeding blades being downstream of, and further removed from said horizontal plane than, said first blade and any other preceding blade.

7. The apparatus of claim 1 wherein each of said at least one other succeeding blades is closer to said horizontal plane than said first blade and any other preceding blade.

8. The apparatus of claim 2 wherein said another plurality of blades is attached to a first foil box and said plurality of blades is attached to a second foil box, and wherein at least one of said blades of at least one of said plurality of blades is vacuum augmented by further suction means.

9. The apparatus of claim 8 wherein said second box includes a first chamber beneath at least one of said blades and a second chamber beneath at least one other of said blades, said first chamber being vacuum augmented at one negative pressure and said second chamber being vacuum augmented at another negative pressure, said second chamber being downstream of said first chamber.

10. The apparatus of claim 4 wherein said another plurality of blades is attached to a first foil box and said plurality of blades is attached to a second foil box, and wherein at least one of said blades of at least one of said plurality of blades is vacuum augmented by further suction means.

11. The apparatus of claim 10 wherein said second box includes a first chamber beneath at least one of said blades and a second chamber beneath at least one other of said blades, said first chamber being vacuum augmented at one negative pressure and said second chamber being vacuum augmented at another negative pressure, said second chamber being downstream of said first chamber.

12. The apparatus of claim 5 wherein said another plurality of blades is attached to a first foil box and said plurality of blades is attached to a second foil box, and wherein at least one of said blades of at least one of said plurality of blades is vacuum augmented by further suction means.

13. The apparatus of claim 12 wherein said second box includes a first chamber beneath at least one of said blades and a second chamber beneath at least one other of said blades, said first chamber being vacuum augmented at one negative pressure and said second chamber being vacuum augmented at another negative pressure, said second chamber being downstream of said first chamber.

14. The apparatus of claim 6 wherein said another plurality of blades is attached to a first foil box and said plurality of blades is attached to a second foil box, and wherein at least one of said blades of at least one of said plurality of blades is vacuum augmented by further suction means.

15. The apparatus of claim 14 wherein said second box includes a first chamber beneath at least one of said blades and a second chamber beneath at least one other of said blades, said first chamber being vacuum augmented at one negative pressure and said second chamber being vacuum augmented at another negative pressure, said second chamber being downstream of said first chamber.

16. The apparatus of claim 1 including means positioned adjacent and downstream of said forming roll above said forming medium and extending in the cross machine direction for catching water which may be flung from said forming roll during the operation thereof.

17. The apparatus of claim 2 including means positioned adjacent and downstream of said forming roll above said forming medium and extending in the cross machine direction for catching water which may be flung from said forming roll during the operation thereof.

18. The apparatus of claim 1 wherein said plurality of blades includes at least one pulse inducing blade.

19. The apparatus of claim 2 wherein said plurality of blades includes at least one pulse inducing blade.

* * * * *